US006285836B1

(12) United States Patent
Kubota

(10) Patent No.: US 6,285,836 B1
(45) Date of Patent: Sep. 4, 2001

(54) PROCESS CARTRIDGE AND PROCESS CARTRIDGE IDENTIFICATION MECHANISM

(75) Inventor: Yasuhiko Kubota, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/520,192

(22) Filed: Mar. 7, 2000

(30) Foreign Application Priority Data

May 12, 1999 (JP) ..... 11-131726

(51) Int. Cl.[7] ..... G03G 15/00
(52) U.S. Cl. ..... 399/12
(58) Field of Search ..... 399/12, 13, 110, 399/111

(56) References Cited

U.S. PATENT DOCUMENTS 4,803,521 * 2/1989 Honda ..... 399/12
4,949,123 * 8/1990 Takashima ..... 399/12
4,963,939 * 10/1990 Kurando et al. ..... 399/12
4,978,995 * 12/1990 Takahashi ..... 399/12
5,075,724 * 12/1991 Wada et al. ..... 399/12
5,666,586 * 9/1997 Nishimura et al. ..... 399/13
5,761,566 * 6/1998 Suzuki et al. ..... 399/12
5,970,273 * 10/1999 Zenk et al. ..... 399/12

FOREIGN PATENT DOCUMENTS 7-152307 6/1995 (JP) .
8-95468 4/1996 (JP) .
9-185311 7/1997 (JP) .

* cited by examiner

*Primary Examiner*—Sandra Brase
(74) *Attorney, Agent, or Firm*—Oliff & Berridge PLC

(57) ABSTRACT

The low-cost, space-saving process cartridge identification mechanism identifies many types of process cartridge without requiring a new electrical logic circuit. Even if a pressing piece goes into a detection portion, switches are not turned on and hence a mounted process cartridge is not detected as long as the pressing piece does not push down a manipulation lever. Identification pieces are provided in an identification unit separately from the pressing piece. In this manner, a mechanism for mechanically identifying a process cartridge based on whether the identification pieces are interfered with by the interference pieces irrespective of turning-on/off of the switches. As a result, by combining combinations of the pressing piece and the manipulation lever and combinations of the identification piece and the interference piece, many combinations of an image forming apparatus and a process cartridge can be obtained at a low cost with space saving without requiring a new electrical logic circuit.

8 Claims, 15 Drawing Sheets

FIG.14

| | | IDENTIFICATION UNIT | | | | | | | | DETECTION DEVICE SIDE | | | | | | | |
|---|---|---|---|---|---|---|---|---|---|---|---|---|---|---|---|---|---|
| | | PRESSING PIECE | | | | IDENTIFICATION PIECE | | | | MANIPULATION LEVER | | | | INTERFERENCE PIECE | | | |
| NO. | KEY NO. | 1 | 2 | 3 | 4 | A | B | D | M | 1 | 2 | 3 | 4 | A | B | D | M |
| 1 | MA1 | ○ | | | | ○ | | | ○ | ○ | | | | | ○ | ○ | |
| 2 | MA2 | | ○ | | | ○ | | | ○ | | ○ | | | | ○ | ○ | |
| 3 | MA3 | | | ○ | | ○ | | | ○ | | | ○ | | | ○ | ○ | |
| 4 | MA4 | | | | ○ | ○ | | | ○ | | | | ○ | | ○ | ○ | |
| 5 | MB1 | ○ | | | | | ○ | | ○ | ○ | | | | ○ | | ○ | |
| 6 | MB2 | | ○ | | | | ○ | | ○ | | ○ | | | ○ | | ○ | |
| 7 | MB3 | | | ○ | | | ○ | | ○ | | | ○ | | ○ | | ○ | |
| 8 | MB4 | | | | ○ | | ○ | | ○ | | | | ○ | ○ | | ○ | |
| 9 | DA1 | ○ | | | | ○ | | ○ | | ○ | | | | | ○ | | ○ |
| 10 | DA2 | | ○ | | | ○ | | ○ | | | ○ | | | | ○ | | ○ |
| 11 | DA3 | | | ○ | | ○ | | ○ | | | | ○ | | | ○ | | ○ |
| 12 | DA4 | | | | ○ | ○ | | ○ | | | | | ○ | | ○ | | ○ |
| 13 | DB1 | ○ | | | | | ○ | ○ | | ○ | | | | ○ | | | ○ |
| 14 | DB2 | | ○ | | | | ○ | ○ | | | ○ | | | ○ | | | ○ |
| 15 | DB3 | | | ○ | | | ○ | ○ | | | | ○ | | ○ | | | ○ |
| 16 | DB4 | | | | ○ | | ○ | ○ | | | | | ○ | ○ | | | ○ |

PROCESS CARTRIDGE AND PROCESS CARTRIDGE IDENTIFICATION MECHANISM

BACKGROUND OF THE INVENTION

1. Field of the Invention

The present invention relates to a process cartridge and a process cartridge identification mechanism for image formation that is mounted in image forming apparatuses such as a laser printer, a facsimile machine, and a copier, as well as to an identification mechanism for such a process cartridge.

2. Description of the Related Art

Among image forming apparatuses are ones in which a process cartridge unit formed by accommodating a photoreceptor drum, a developer, etc. in a housing is provided in a detachable manner to improve the ease of maintenance and provide better service.

The specifications of internal functional components and a toner may vary among process cartridges due to various differences in the specifications of apparatus main bodies where the process cartridges are used, whereas external components such as a housing are common to the process cartridges. In this case, if a process cartridge is not compatible with an apparatus main body, a failure in image quality or malfunctioning of the apparatus may occur. To prevent such an event, it is necessary to employ a mechanism for prohibiting the use of such a process cartridge.

However, a conventional identification mechanism as disclosed in Japanese Unexamined Patent Publication No. Hei. 7-152307, for example, which electrically detects a process cartridge type, is not so configured as to identify many process cartridge types.

Japanese Unexamined Patent Publication No. Hei. 9-185311 discloses an identification mechanism in which the logo mark of a process cartridge is recognized by means of a switch. However, this identification mechanism has a problem that a process cartridge cannot be identified unless it is mounted correctly because the structure of the mechanism does not allow a large projection/recess amount of a logo mark nor a long stroke of the switch.

Further, it is necessary to provide, in addition to such an identification mechanism, the following components in the mounting section. That is, as shown in FIG. 15, it is necessary to provide not only a detection switch 88 for detecting whether a process cartridge is mounted and an interlock switch for turning off the apparatus when a process cartridge is removed or a main body cover is opened, but also a power switch 90 for turning off the power of a laser diode to secure the safety.

In view of the above, for example, a configuration is possible in which seven projection plates 92 are provided on the process cartridge 10 side and eight engagement portions 96 are provided at such positions as to be able to engage the projection plates 92 by elongating an actuator portion 94 on the mounting section side in the horizontal direction. A manipulation lever 98 for manipulating the detection switch 88 and the power switch 90 is selectively provided in the engagement portions 96 and is pushed down by the corresponding one of the projection plates 92. This configuration enables seven combinations of an image forming apparatus and a process cartridge. However, since the actuator portion 94 occupies a large space in the horizontal direction, this configuration is not efficient in terms of space utilization.

It is also possible to provide a maximum of 16 combinations by using an electrical logic circuit having 4-bit switches. However, a large-size assembly is needed to incorporate, to secure the safety, switches having a capacity large enough to turn off the power of a laser diode. It is noted that it is possible to replace the power switch 90 for turning off the power of the laser diode with another means.

SUMMARY OF THE INVENTION

The present invention has been made in view of the above circumstances and provides a low-cost, space-saving process cartridge and a process cartridge identification mechanism which can identify many process cartridge types and has a process cartridge detection function without requiring a new electrical logic circuit, as well as to a process cartridge to be identified by such an identification mechanism.

According to a first aspect of the invention, a process cartridge is mounted in a mounting section of an image forming apparatus. The process cartridge is provided with a pressing member. When the process cartridge is mounted in the mounting section, the pressing member operates an operating member provided in the image forming apparatus if the pressing member corresponds to the operating member and thereby causes a detection device to detect that the process cartridge is mounted regularly. In other words, if the pressing member does not correspond to the operating member, the operating member is not operated and the detecting device does not detect the process cartridge even when the process cartridge is mounted.

Further, a projection/recess member is provided in the mounting section separately from the operating member, and an identification member is provided in the process cartridge separately from the pressing member. In this manner, a mechanism for mechanically identifying a process cartridge irrespective of the detection device based on whether the identification member is interfered with by a projection portion of the projection/recess member is provided.

With the above configuration, by combining combinations of the pressing member and the operating member and combinations of the identification member and the projection/recess member, many combinations of an image forming apparatus and a process cartridge can be obtained at a low cost with space saving without requiring a new electrical logic circuit.

Accordion to the second aspect of the invention, the projection/recess member may be a stopper member that has different projection/recess forms and can be attached to and removed from the mounting section.

According to the third aspect of the invention, the identification member may be an identification unit having a claw piece that is fixed to the process cartridge by one-touch action.

According to the fourth aspect of the invention, a cover that opens and closes the mounting section may be closable even when the identification member is interfered with by the projection portion of the projection/recess member.

According to the fifth aspect of the invention, the projection/recess member may have a projection/recess form that is a projection approximately parallel with a mounting direction of the process cartridge.

The identification member may be provided at an end portion of the process cartridge.

According to the 7–9 aspects of the invention, an identification unit is fixed to a surface of a process cartridge. The identification unit is provided with a pressing member and an identification member. As in the case of the first aspect, many combinations of an image forming apparatus and a process cartridge can be obtained at a low cost with space saving without requiring a new electrical logic circuit.

BRIEF DESCRIPTION OF THE DRAWINGS

FIG. 14 is a table showing combinations of the identification unit side and the detection device side.

DETAILED DESCRIPTION OF THE PREFERRED EMBODIMENT

Figure 1:
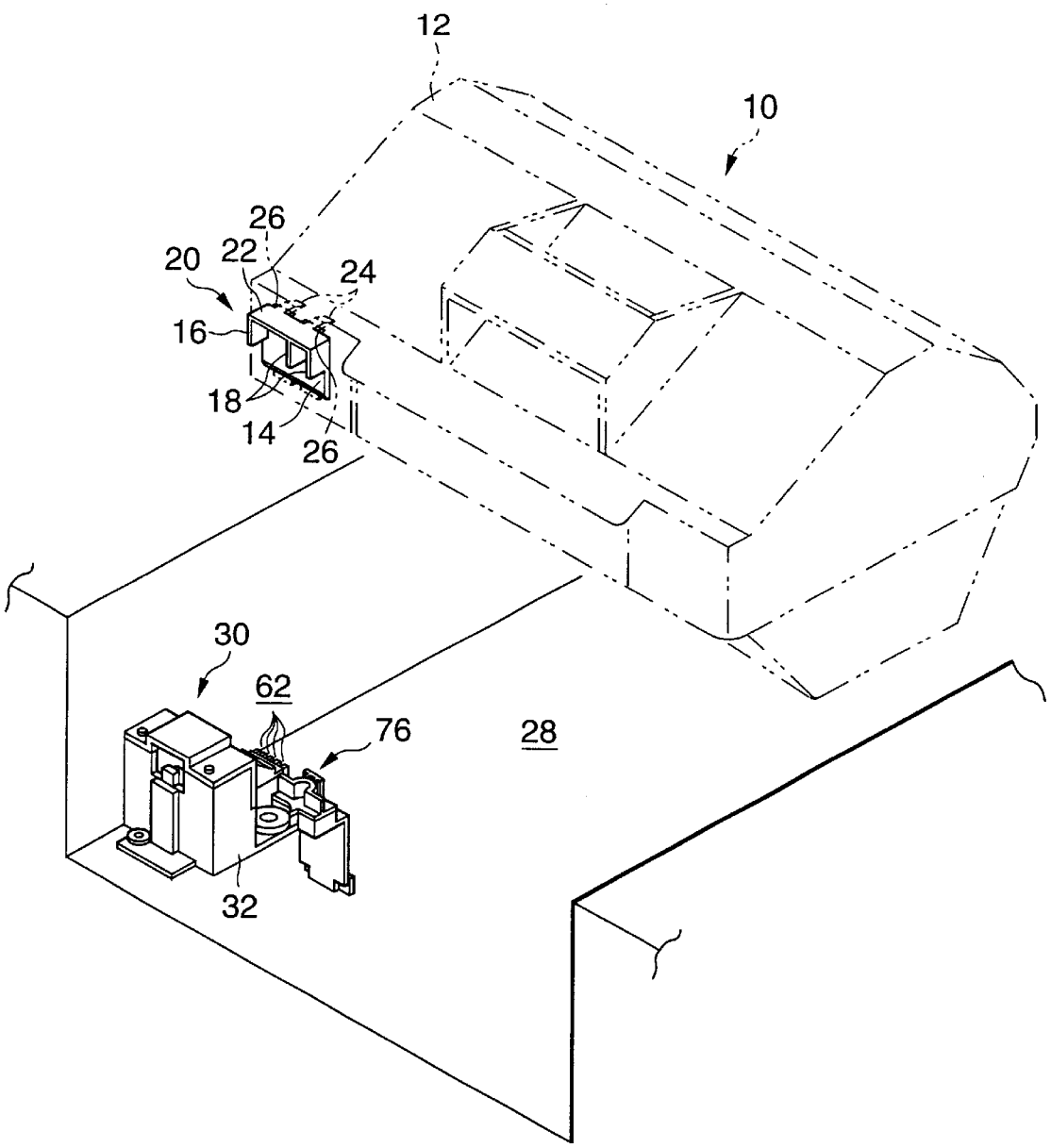
FIG. 1 is a perspective view of a process cartridge identification mechanism according to an embodiment of the present invention.

A process cartridge identification mechanism according to an embodiment of the present invention will be hereinafter described with reference to the accompanying drawings.

As shown in FIGS. 1–4, a process cartridge 10 has a housing 12 that accommodates a photoreceptor drum, a development roller, and a developer. An identification unit 20 in which a pressing piece 16 and identification pieces 18 project forward from a base plate 14 is attached to the front end portion of the housing 12. The top portions of the pressing piece 16 and the identification pieces 18 are connected to each other by a reinforcement plate 22.

The bottom portion of the base plate 14 is formed with hook claws 99. The hook claws 99 are inserted and set in an opening 21 of the housing 12, and then the identification unit 20 is turned toward the housing 12. Two claw pieces 24 project from the back surface of the base plate 14. The tip portion of each claw piece 24 is formed with a claw portion 24A whose thickness decreases toward the tip. When the identification unit 20 is turned, the claw portions 24A are fixed to engagement holes 26 of the housing 12 by one-touch action, whereby the identification unit 20 is attached to the housing 12. In this manner, the identification unit 20 is configured so as not to be removed from the outside once attached to the housing 12 unless it is broken. Since the identification unit 20 is disposed at an end portion of the housing 12, the end portion that tends to be a dead space can be utilized effectively.

Figure 2:
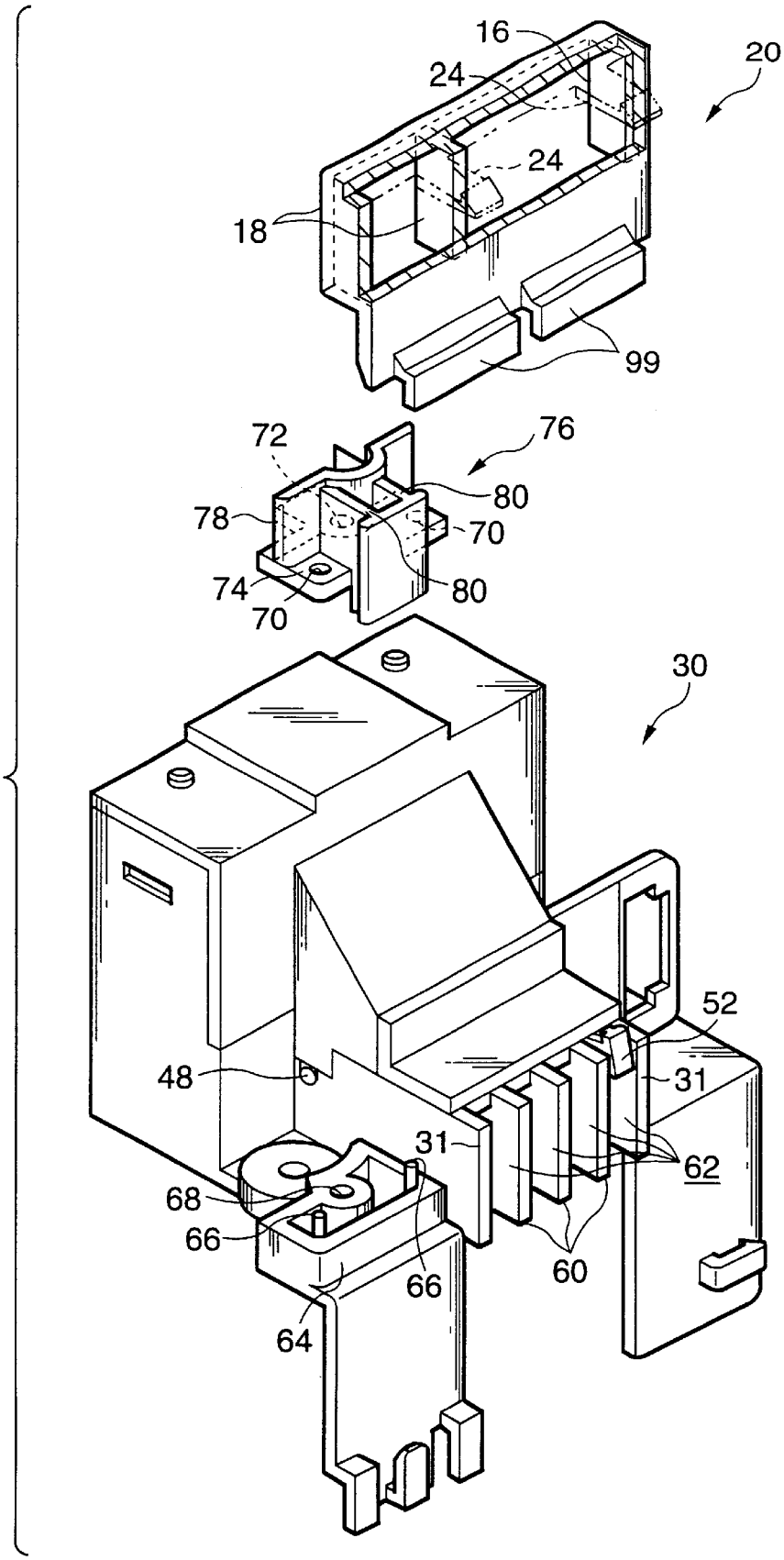
FIG. 2 is a perspective view showing a positional relationship between a stopper member and an identification unit according to the embodiment.
Figure 3:
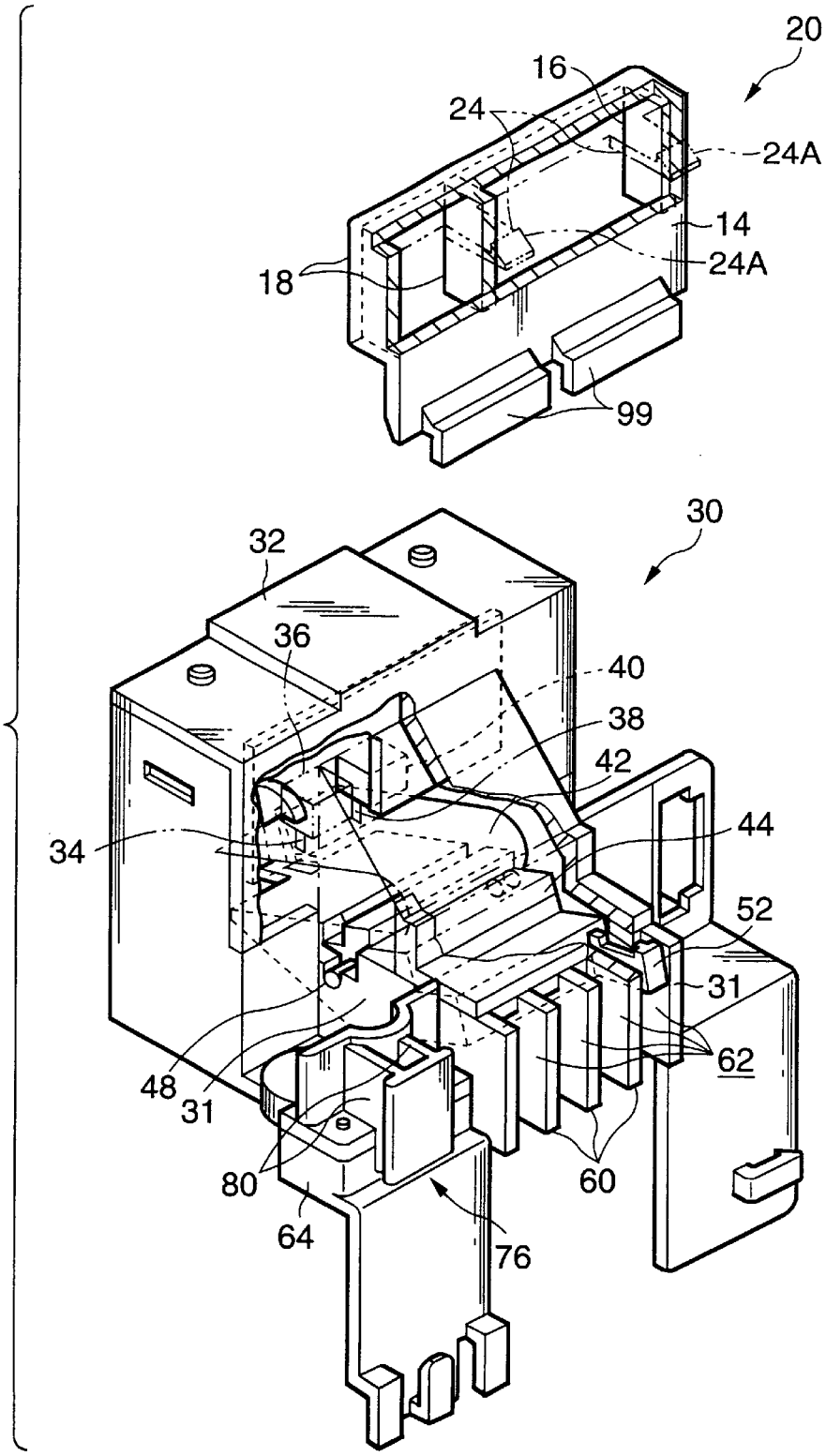
FIG. 3 is a partially cutaway perspective view showing a positional relationship between the stopper member and the identification unit according to the embodiment.
Figure 4:
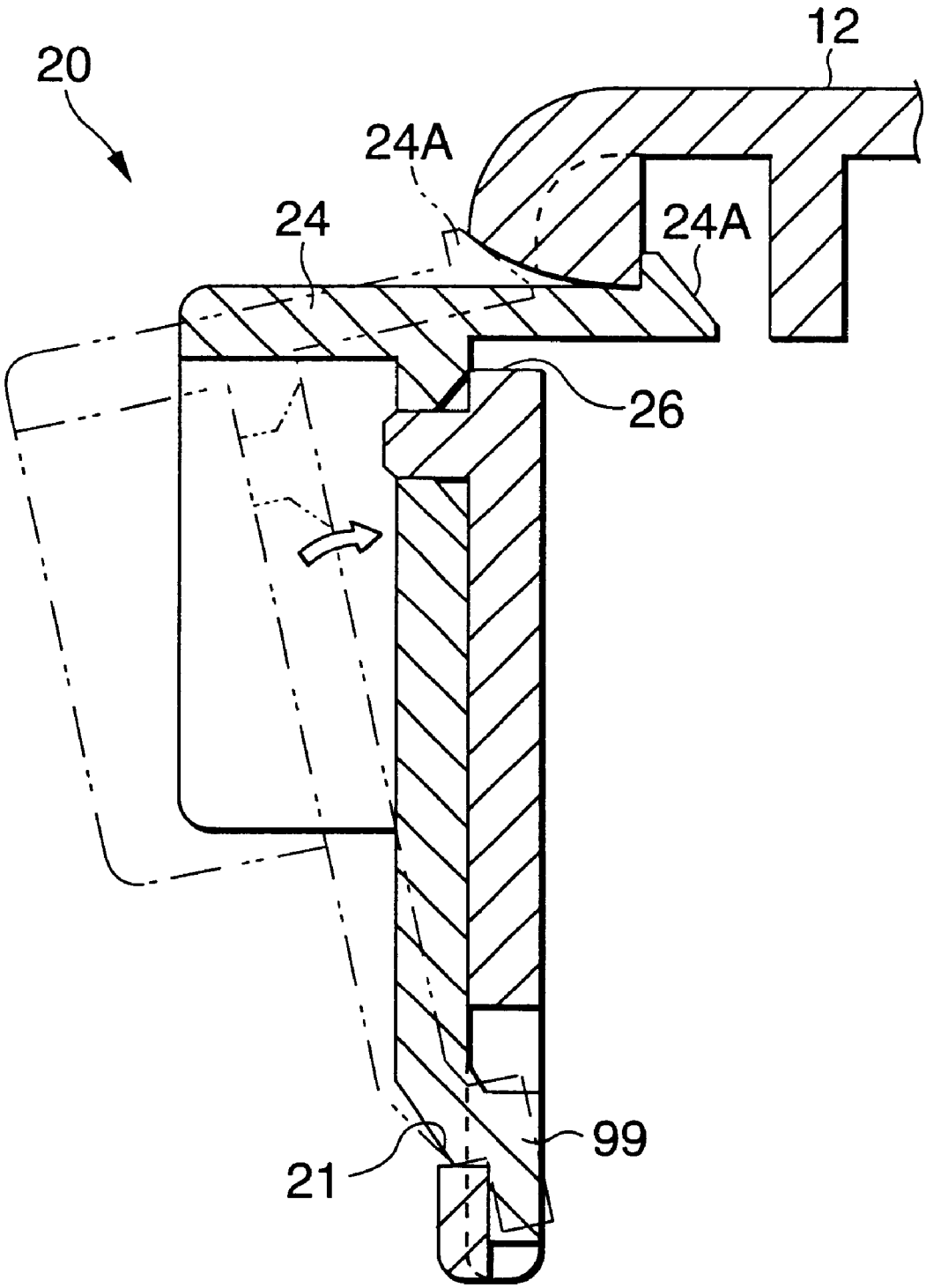
FIG. 4 is a side sectional view showing the attachment structure of the identification unit according to the embodiment.

On the other hand, as shown in FIGS. 2 and 3, a detecting device 30 is provided on the mounting section 28 side. A detection switch 36 that is on/off-manipulated by a switch knob 34 and detects presence of the process cartridge 10 and a power switch 40 that is manipulated by a switch knob 38 and turns on/off a laser light source of an optical scanning device are provided in a housing 32 of the detection device 30.

Figure 5:
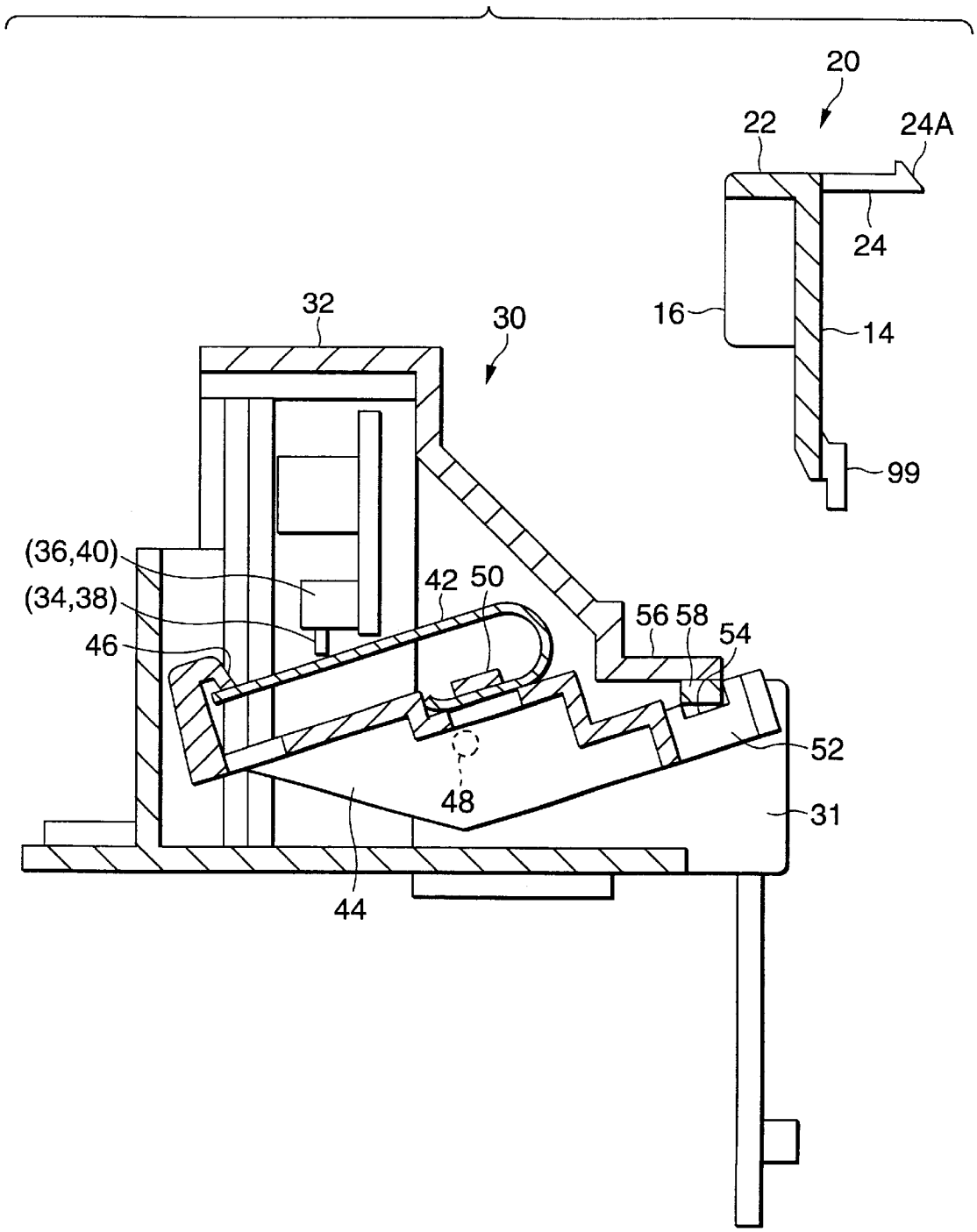
FIGS. 5–7 are side sectional views showing movement of a manipulation plate in the embodiment.
Figure 6:
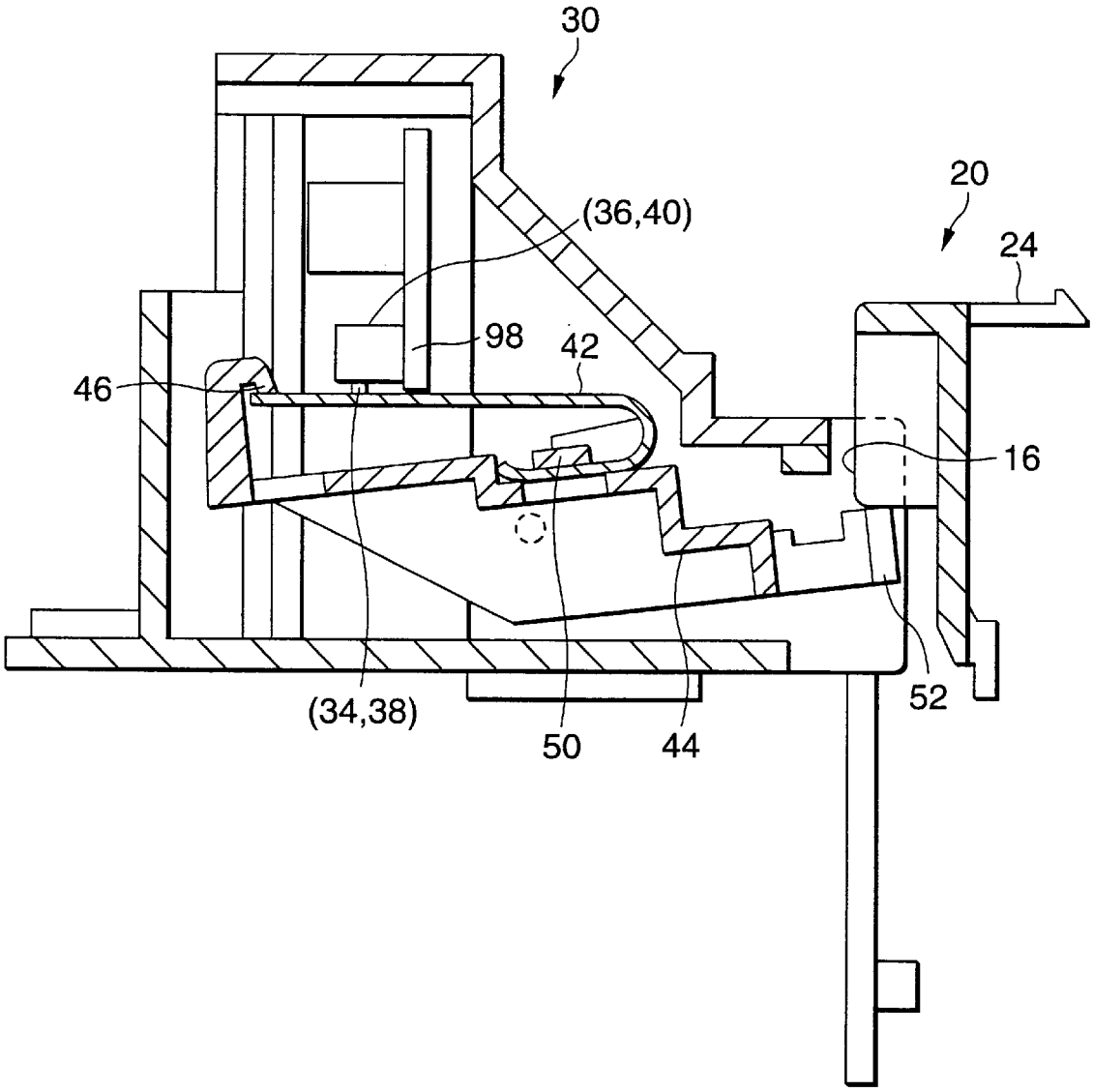

As shown in FIGS. 5 and 6, the switch knobs 34 and 38 are turned on or off at the same time being pushed by a leaf spring 42. The leaf spring 42 is bent so as to assume a J-shape and one end of the leaf spring 42, that is, the end of its straight portion, is engaged with a presser portion 46 of a manipulation plate 44.

A pin 48 extending from a central portion of the manipulation plate 44 is supported by a side plate 31 of the housing 32 in such a manner that the manipulation plate 44 is swingable. A presser plate 50 located at a central portion of the manipulation plate 44 presses the other end of the leaf spring 42, that is, the end of its curved portion.

With the above structure, when the manipulation plate 44 is free, the urging force of the leaf spring 42, the returning forces of the switch knobs 34 and 38, and the angular moment that occurs because the centers of gravity of the manipulation plate 44 and the leaf spring 42 are located on the left of the pin 48 cause the manipulation plate 44 to incline in such a direction that the presser portion 46 goes down. Therefore, the switch knobs 34 and 38 are not pushed up by the leaf spring 42.

A manipulation lever 52 is attached to the tip portion of the manipulation plate 44. The tip portion of the manipulation lever 52 is formed, at the top, with a recessed engagement portion 54. When the manipulation plate 44 is inclined in such a direction that the presser portion 46 goes down, the engagement portion 54 engages a projection portion 58 that is provided at the end of a top cover 56.

As shown in FIGS. 2 and 3, three partition plates 60 are provided between the side plates 31, whereby four gaps (detection portions 62) where the manipulation lever 52 can move vertically are formed. The pressing piece 16 goes into the corresponding one of the detection portions 62 and pushes down the manipulation lever 52, whereby the manipulation plate 44 is swung and the leaf spring 42 turns on the detection switch 36 and the power switch 40.

A receiving stage 64 is formed, as part of the walls, outside one of the side plates 31. The receiving stage 64 is formed with positioning pins 66 and a screw hole 68. A stopper member 76 having a substrate 74 that is formed with engagement holes 70 to engage the positioning pins 66 and a through-hole 72 into which a screw to be screwed to the screw hole 68 is to be inserted is set on the receiving stage 64.

The stopper member 76 has a vertical wall 78 that erects from the substrate 74 and two interference pieces 80 that project horizontally from the vertical wall 78. If at least one of the interference pieces 80 butts against the identification pieces 18, it means that the process cartridge 10 is not compatible with the image forming apparatus. However, even in such a case, a main body cover (not shown) of the image forming apparatus can be closed.

That is, the height relationship among the manipulation lever 52, the interference pieces 80, and the identification pieces 18 is set in such a manner that even if the pressing piece 16 corresponds to the manipulation lever 52 that is located in one of the detection portions 62, the pressing piece 16 cannot push down the manipulation lever 52 completely as long as the identification pieces 18 butt against at least one of the interference pieces 80. By making the main body cover (not shown) closable even in a state that the manipulation lever 52 cannot be pushed down completely, an event can be prevented that a user who does not recognize incompatibility between the process cartridge 10 and the image forming apparatus tries to forcibly push the process cartridge 10 in place. Therefore, the apparatus main body can be prevented from being damaged. A message to the effect that the process cartridge 10 is not correct is displayed if the switches 36 and 40 are not turned on.

Since the interference pieces 80 and the vertical wall 78 extend in the direction that is approximately parallel with the mounting direction of the process cartridge 10, the process cartridge 10 can be mounted and identified reliably even if there is some play due to an error in manufacture, for example.

Next, the process cartridge identification mechanism according to the embodiment will be described by using a specific example.

Figure 8:
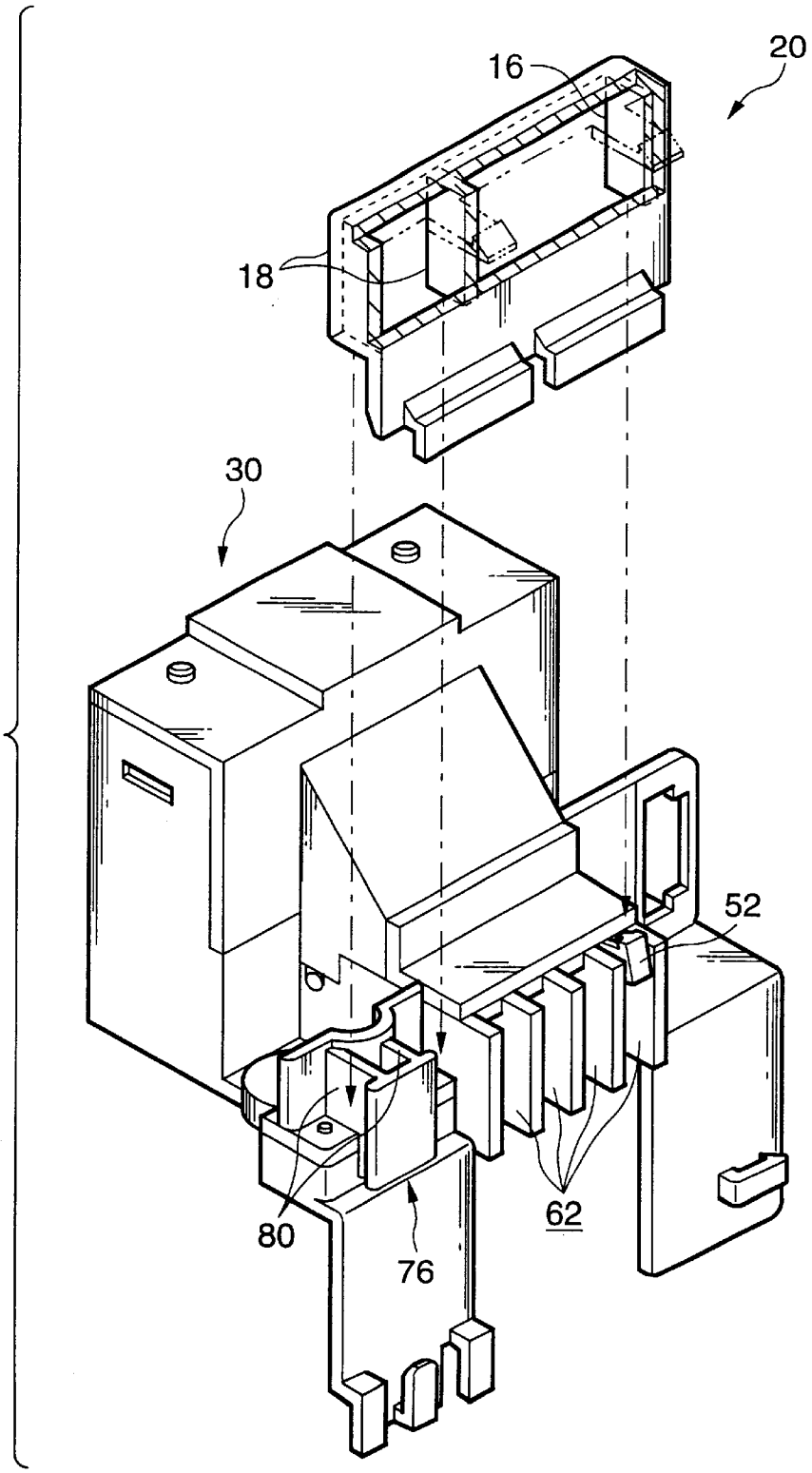
FIGS. 8 and 9 are a perspective view and a front view, respectively, showing a corresponding relationship between the stopper member and the identification unit in the embodiment.
Figure 9:
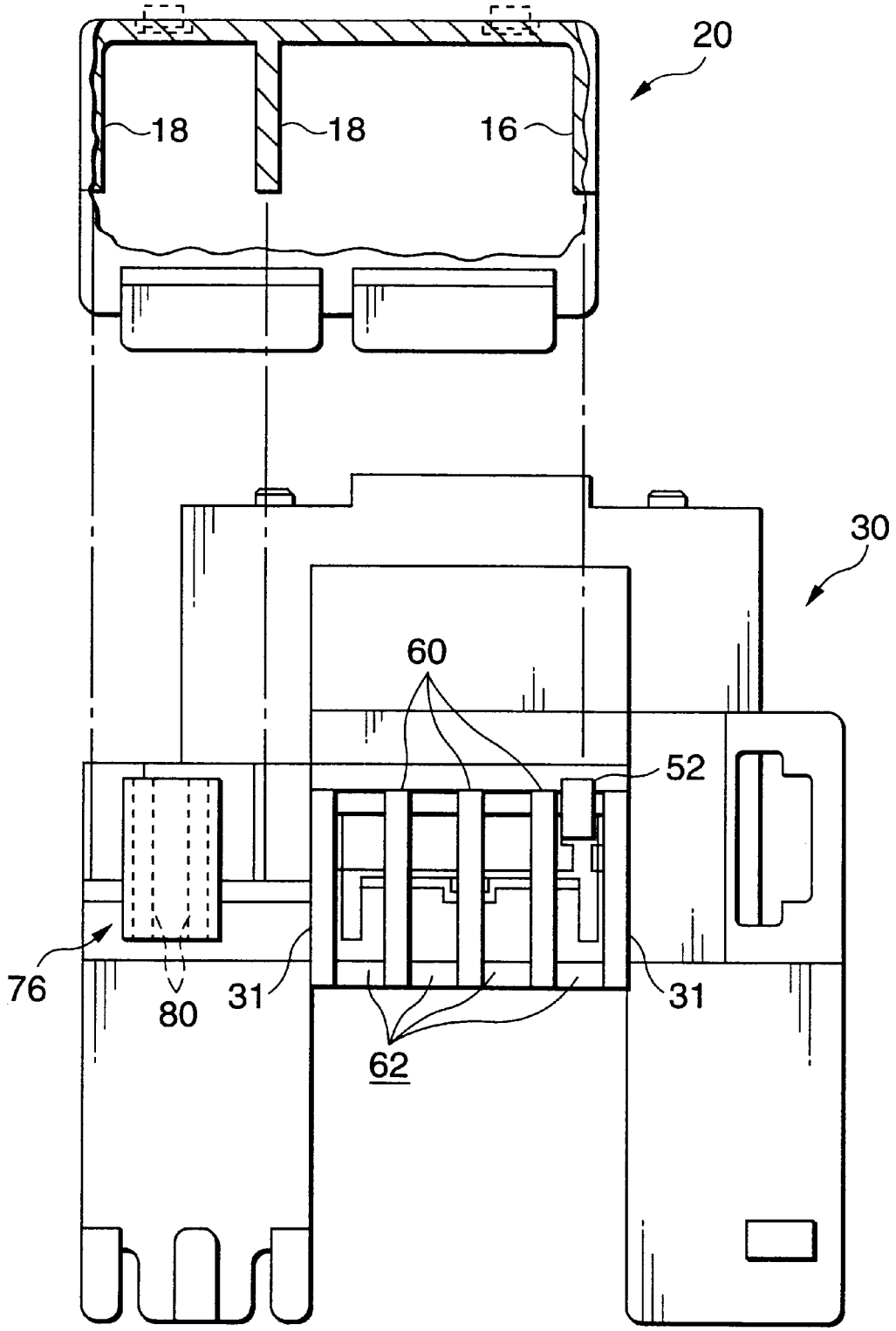
Figure 10:
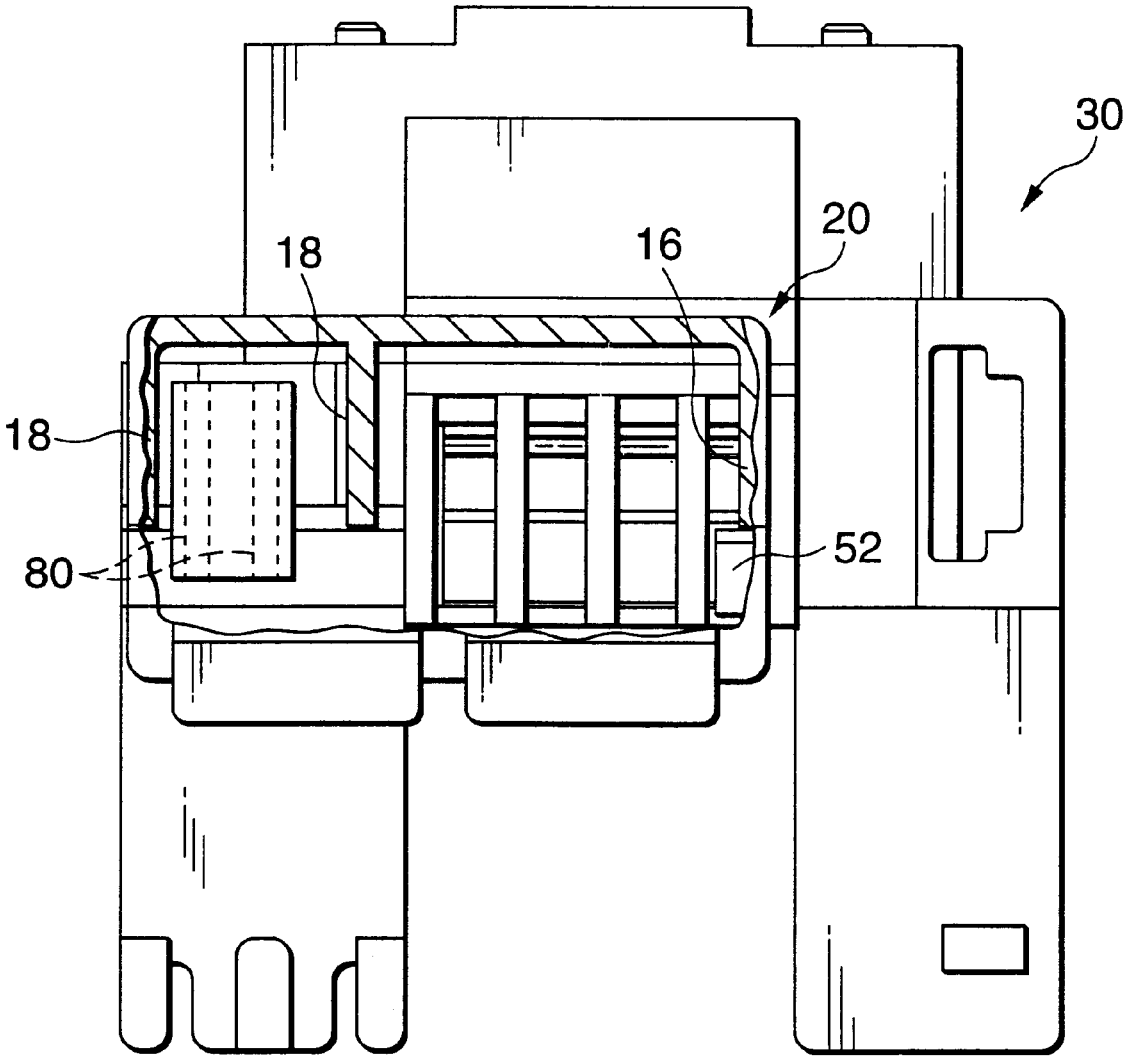
FIG. 10 is a front view showing a state that the stopper member and the identification unit are engaged with each other in the embodiment.

If the process cartridge 10 is compatible with the image forming apparatus, the pressing piece 16 of the identification unit 20 goes into the corresponding detection portion 62 and pushes down the manipulation lever 52 of the detection device 30 as shown in FIGS. 8–10. As shown in FIG. 10, since the interference pieces 80 do not interfere with the identification pieces 18, the process cartridge 10 can be mounted in the mounting section without any problem.

Since the pressing piece 16 pushes down the manipulation lever 52, the manipulation lever 44 is swung clockwise and the leaf spring 42 pushes up the switch knobs 34 and 38 as shown in FIG. 6, whereby the detection switch 36 and the power switch 40 are turned on. Mounting of the process cartridge 10 is confirmed in this manner to establish a state the laser light source can be turned on.

The function of the leaf spring 42 will now be described.

Figure 7:
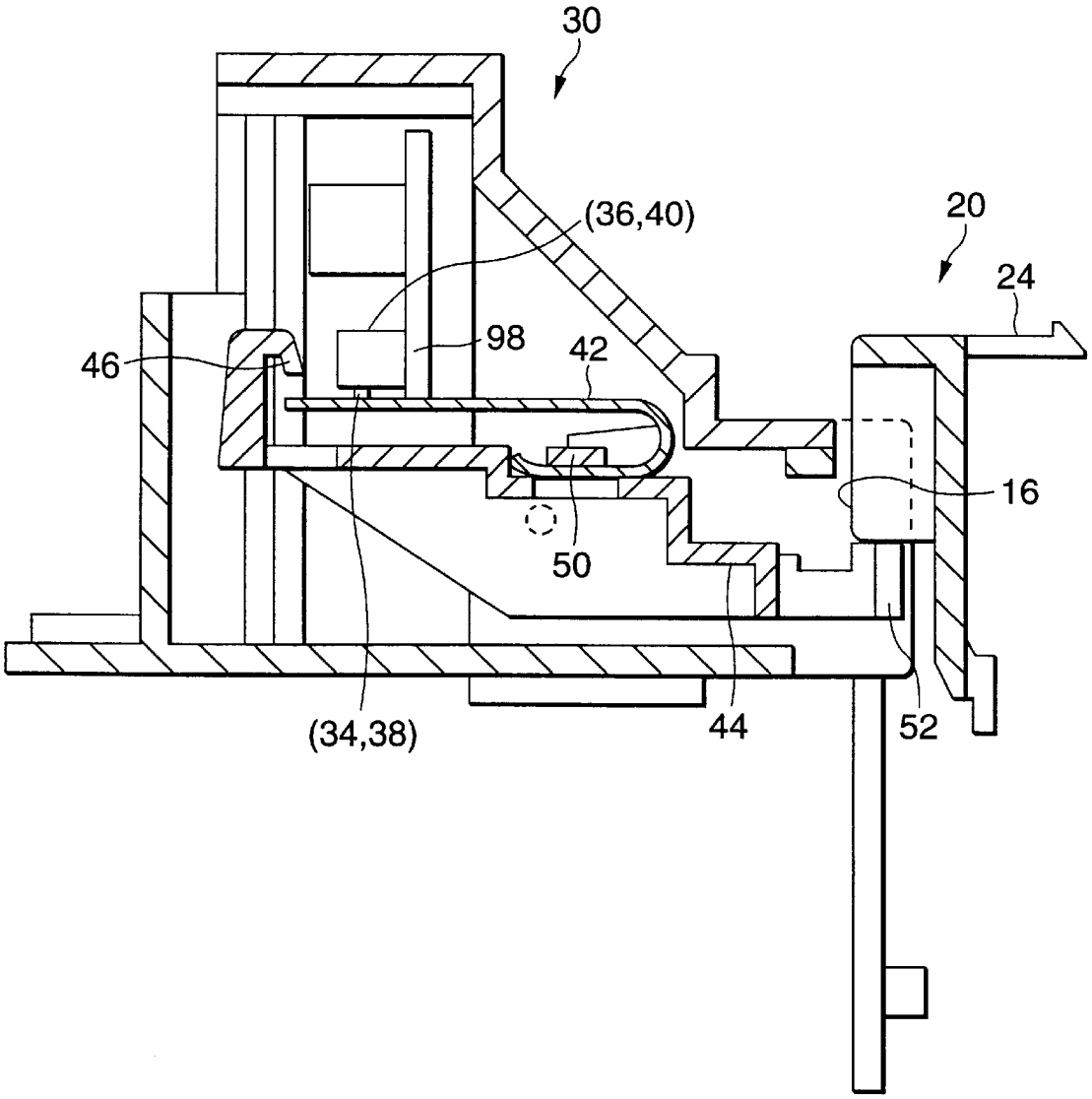

When the inserted process cartridge 10 comes to a position immediately before the mounting position, the switches 36 and 40 are turned on by the leaf spring 42 as shown in FIG. 6. When the process cartridge 10 is set at the mounting position, the leaf spring 42 keeps the switches 36 and 40 in the on-states while being stopped and bent by the lower end of the substrate 98 of the switches 36 and 40 (the end of the leaf spring 42 is separated from the presser portion 46) as shown in FIG. 7.

The leaf spring 42 increases the reliability because it can push up the switches 36 and 40 even if the mounting position (in the vertical direction) of the process cartridge 10 varies in a wide range. Even if the process cartridge 10 goes down from the position of FIG. 7, the leaf spring 42 is further bent and the on-states are continued without destroying the switches 36 and 40.

Figure 11:
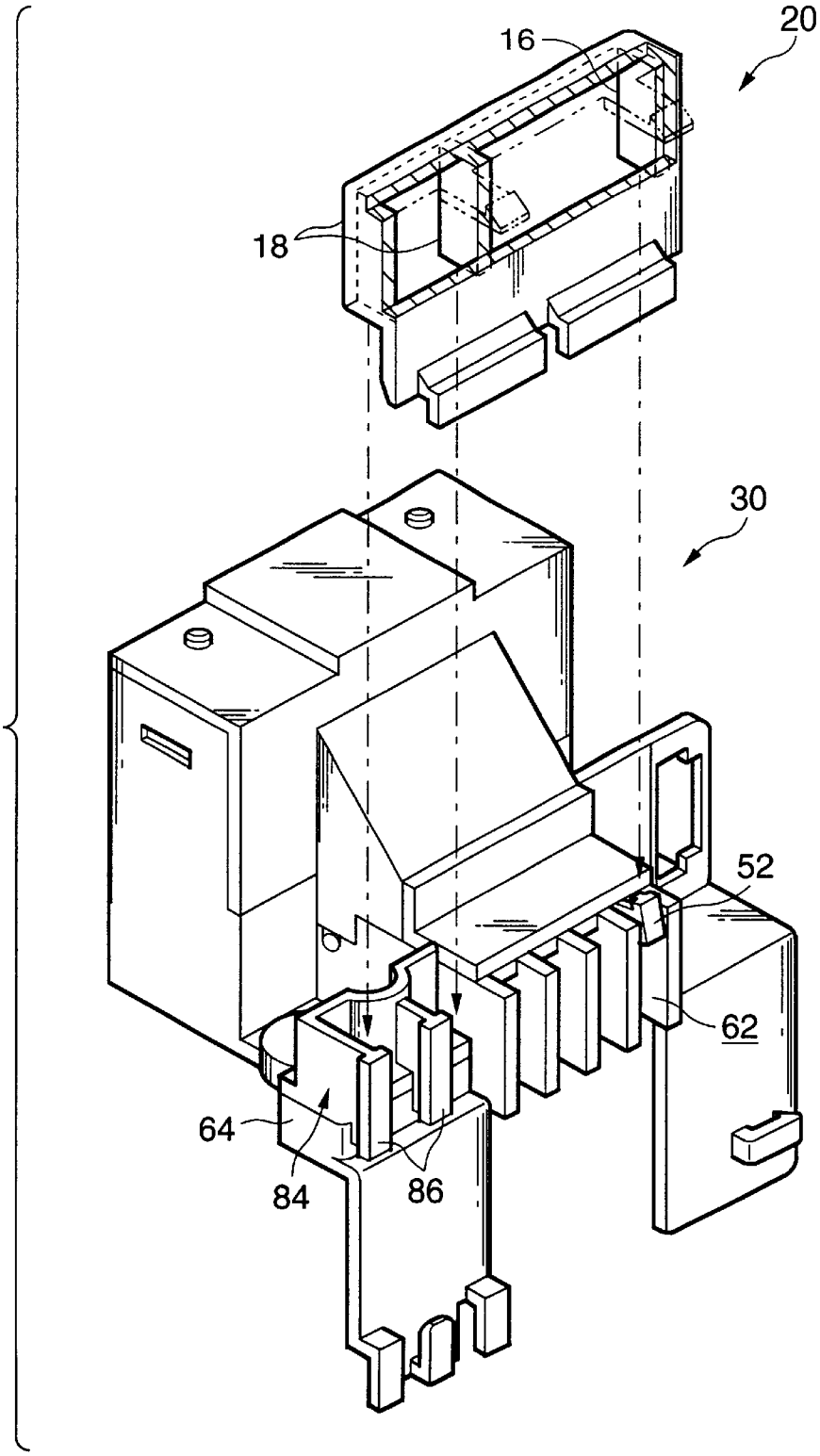
FIGS. 11 and 12 are a perspective view and a front view, respectively, showing a state that the stopper member and the identification unit do not conform to each other in the embodiment.
Figure 12:
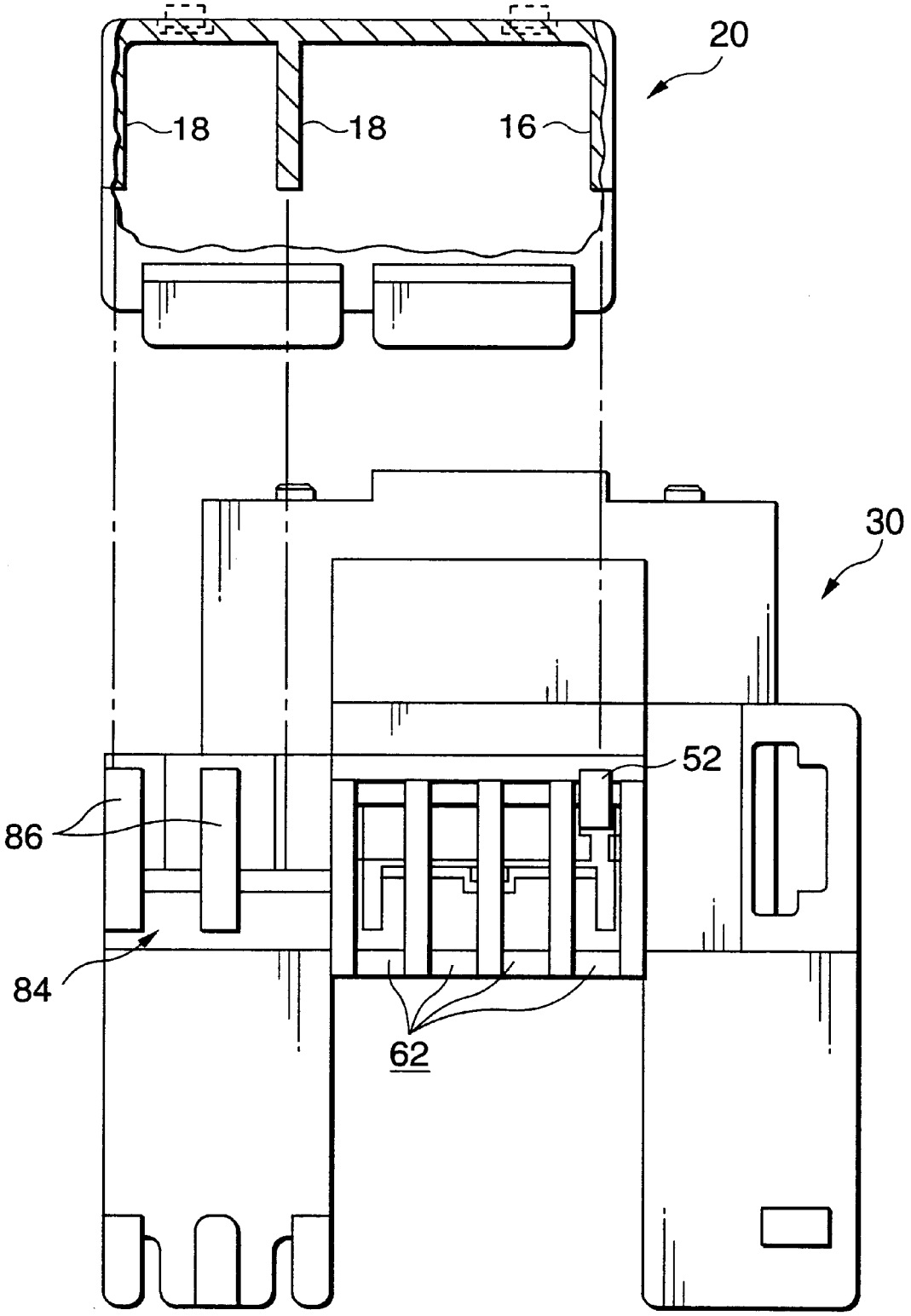

Assume a case that a stopper member 84 of another product type is attached to the receiving stage 64 without switching the identification unit 20 as shown in FIG. 11 and FIG. 12. In this case, although the central identification piece 18 receives no interference, the left-hand identification piece 18 butts against one of the interference pieces 86.

Even if the left-hand identification piece 18 butts against the one interference piece 86, the process cartridge 10 can be moved to such a position that the main body cover can be closed and hence no unduly strong force is applied to the apparatus main body. In this state, although the pressing piece 16 is in the corresponding detection portion 62, it does not push down the manipulation lever 52 completely. Therefore, the detection switch 36 and the power switch 40 are not turned on and a message to the effect that the process cartridge 10 is not compatible is displayed. This allows a user to recognize the use of an erroneous process cartridge 10.

The identification mechanism of this embodiment can accommodate many product types by switching the combination of the arrangement of identification unit the manipulation lever 52 and the stopper member. Therefore, during manufacture, management may be made on a stopper member/identification unit basis rather than a process cartridge housing basis. This saves the storage space and makes it easier to change the metal mold.

Finally, what number of combinations are possible will be described with reference to a schematic diagram of FIG. 13 and a table of FIG. 14. The invention is not limited to the following combinations but intended to reduce the cost and the necessary space by enabling many combinations by providing an electrical detection part and a mechanical identification part.

In FIG. 14, the positions of the pressing piece of the identification unit 20 and the positions of the manipulation lever on the detection device 30 side are represented by numerals 1, 2, 3, and 4. The positions of the identification piece of the identification unit 20 and the positions of the interference piece of the stopper member on the detection device 30 side are represented by characters A, B, D, and M.

Figure 13:
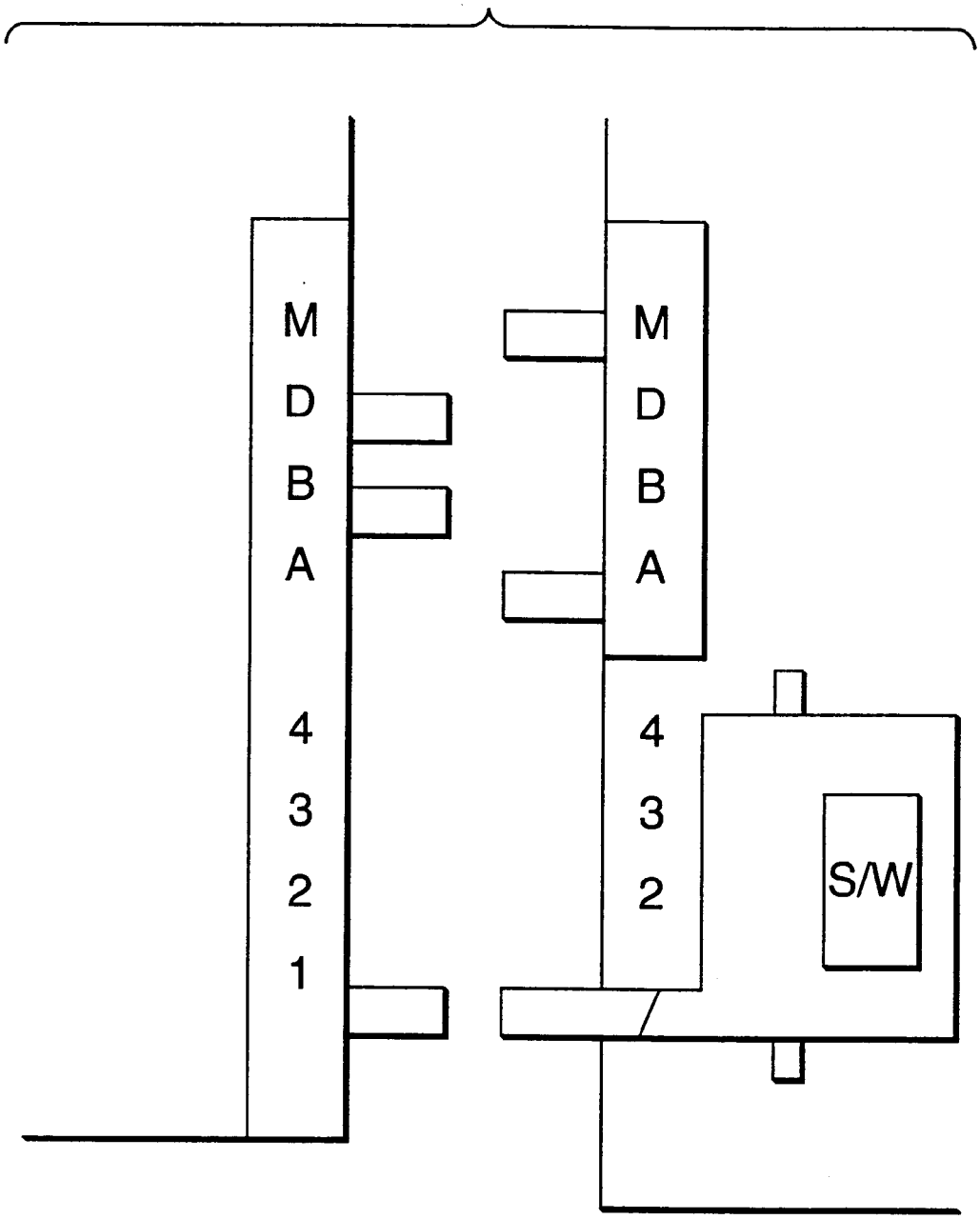
FIG. 13 schematically shows a specific combination of the identification unit side and the detection device side.
Figure 15:
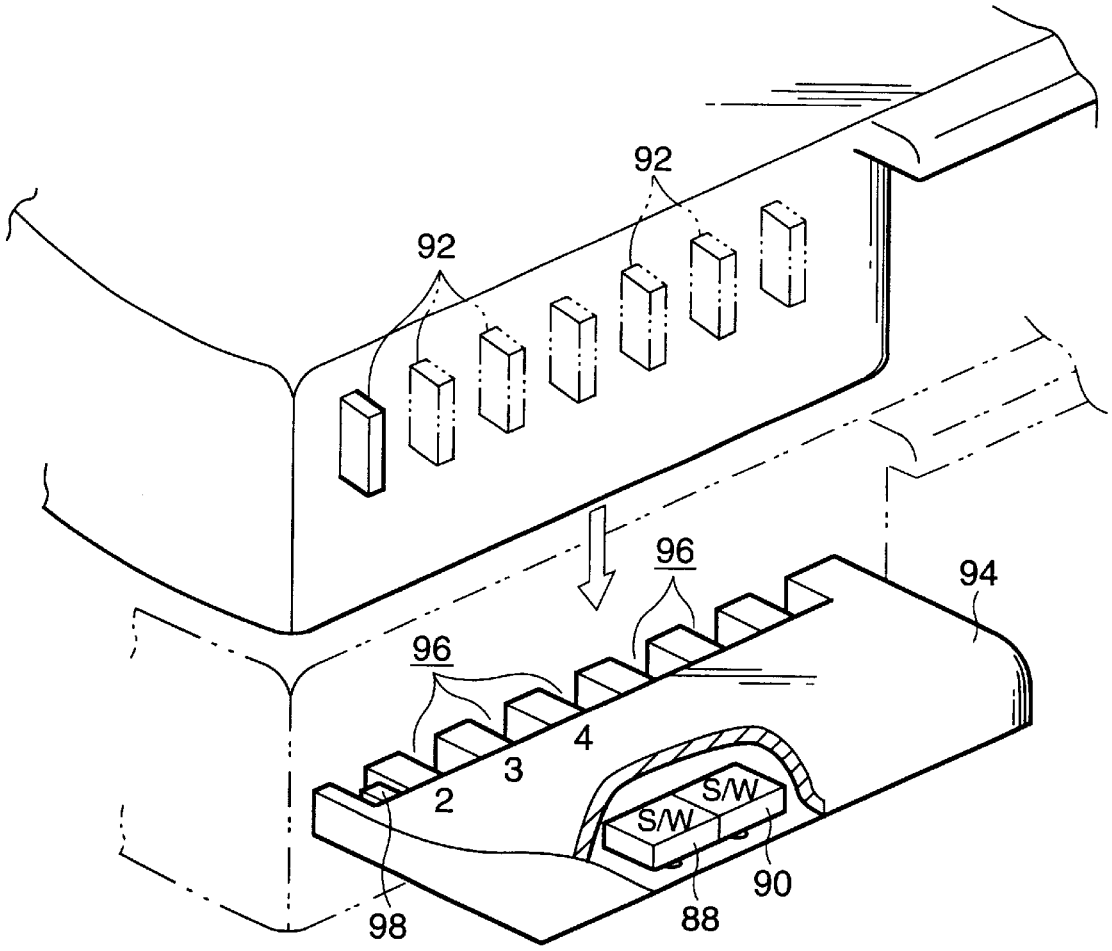
FIG. 15 is a perspective view showing a conventional process cartridge identification mechanism.

As shown in FIG. 13, the table of FIG. 14 should be seen in such a manner that when the identification unit 20 side is in the No. 1 state ("MA1"), only the combination "DB1" is allowed on the detection device 30 side. For example, if the detection device 30 side in the "DB2" state, the process cartridge 10 can a be mounted without receiving any interference because the pressing piece goes into the corresponding detection portion and the interference pieces do not interfere with the identification pieces. However, since the pressing piece located at position "1", does not correspond to the manipulation lever located at position "2," neither the detection switch 36 nor the power switch 40 is turned on.

That is, FIG. 14 shows that a relationship (maximum number of combinations)=(number of kinds of pressing piece (number of kinds of manipulation lever))×(number of kinds of identification piece (number of kinds of interference piece)) holds and 16 combinations are possible. Although two identification pieces and two interference pieces are provided in the embodiment, eight combinations are still possible if one identification piece and one interference piece are provided.

Having the above configuration, the invention makes it possible to maintain a process cartridge detection function by using a conventional detection device without the need for providing a new logic circuit, as well as to identify process cartridge types at a low cost with space saving.

What is claimed is:

1. A process cartridge identification mechanism comprising:

a detection device that is provided in a mounting section of an image forming apparatus and detects whether a process cartridge exists in the mounting section;

an operating member that operates the detection device;

a pressing member that is provided in the process cartridge and operates the operating member if the pressing member corresponds to the operating member;

a projection/recess member that is provided in the mounting section; and an identification member that is provided in the process cartridge and prevents the pressing member from operating the operating member when interfered with by a projection portion of the projection/recess member.

2. The identification mechanism according to claim 1, wherein the projection/recess member is a stopper member that has different projection/recess forms and can be attached to and removed from the mounting section.

3. The identification mechanism according to claim 1, wherein the identification member is an identification unit having a claw piece that is fixed to the process cartridge by one-touch action.

4. The identification mechanism according to claim 1, wherein a cover that opens and closes the mounting section is closable even when the identification member is interfered with by the projection portion of the projection/recess member.

5. The identification mechanism according to claim 1, wherein the projection/recess member has a projection/recess form including a projection approximately parallel to a mounting direction of the process cartridge.

6. The identification mechanism according to claim 1, wherein the identification member is provided at an end portion of the process cartridge.

7. A process cartridge to be mounted in a mounting section of an image forming apparatus, comprising:

an identification unit that is provided on a surface of the process cartridge and faces a detection device provided in the mounting section when the process cartridge is mounted in the mounting section, the identification unit comprising:

a pressing member that operates an operating member provided in the detection device when the process cartridge is mounted in the mounting section; and an identification member that prevents the pressing member from operating the operating member when interfered with by a projection portion of a projection/recess member provided in the mounting section; and a fixing member that fixes the identification unit to the surface of the process cartridge.

8. The process cartridge according to claim 7, wherein the fixing member comprises:

an insertion portion having an opening formed in one or both of the process cartridge and the identification unit; and a claw portion that is inserted in the opening and formed in one or both of the process cartridge and the identification unit.

* * * * *